US005224277A

United States Patent [19]

Sang Do

[11] Patent Number: 5,224,277

[45] Date of Patent: Jul. 6, 1993

[54] FOOTWEAR SOLE PROVIDING VENTILATION, SHOCK ABSORPTION AND FASHION

[76] Inventor: Kim Sang Do, Mokdong Sinsigaji Apt. 723-403, Mokdong 926, Yangcheon-gu, Seoul, Rep. of Korea

[21] Appl. No.: 873,664

[22] Filed: Apr. 23, 1992

Related U.S. Application Data

[63] Continuation of Ser. No. 586,606, Sep. 21, 1990, abandoned.

[30] Foreign Application Priority Data

May 22, 1990 [KR] Rep. of Korea ..... 90-6939

[51] Int. Cl.[5] ..... A43B 13/28

[52] U.S. Cl. ..... 36/27; 36/3 R; 36/3 B; 36/28; 36/35 R

[58] Field of Search ..... 36/3 R, 3 A, 3 B, 28, 36/29, 35 R, 35 B, 27

[56] References Cited

U.S. PATENT DOCUMENTS

| | | | |
|---|---|---|---|
| 103,770 | 5/1870 | Parish | 36/3 B |
| 635,101 | 10/1899 | Kennedy . | |
| 989,894 | 4/1911 | Byrne | 36/3 B |
| 1,109,130 | 9/1914 | Kaye | 36/29 |
| 1,932,557 | 6/1931 | Meucci . | |
| 2,074,121 | 3/1937 | Goodyear | 36/22 |
| 2,128,134 | 8/1938 | Giusto | 36/7.5 |
| 2,266,476 | 12/1941 | Riess | 36/3 |
| 2,532,742 | 2/1949 | Stonier | 36/35 |
| 2,559,609 | 11/1948 | Foust . | |
| 2,720,041 | 3/1953 | Kajtar . | |
| 2,884,716 | 5/1959 | Shelare et al. | 36/3 |
| 2,989,812 | 6/1961 | Lemon | 36/76 R |
| 3,044,190 | 7/1962 | Urbany | 36/29 |
| 3,180,039 | 4/1965 | Burns, Jr. | 36/3 |
| 3,475,836 | 11/1969 | Brahm | 36/3 |
| 3,791,051 | 2/1974 | Kamimura | 36/44 |
| 4,000,566 | 1/1977 | Famolare, Jr. | 36/28 |
| 4,078,321 | 3/1978 | Famolare, Jr. . | |
| 4,417,407 | 11/1983 | Fukuoka | 36/3 B |
| 4,499,267 | 2/1985 | Kim | 36/3 B |
| 4,602,441 | 7/1986 | Sakkaf | 36/3 R |
| 4,610,099 | 9/1986 | Signori | 36/3 B |
| 4,654,982 | 4/1987 | Lee | 36/3 R |
| 4,774,774 | 10/1988 | Allen, Jr. . | |
| 4,845,863 | 7/1989 | Yung-Mao . | |
| 4,942,677 | 7/1990 | Flemming et al. | 36/27 |

FOREIGN PATENT DOCUMENTS

| | | | |
|---|---|---|---|
| 532936 | 8/1931 | Fed. Rep. of Germany | 36/3 B |
| 2902608 | 8/1979 | Fed. Rep. of Germany | 36/29 |
| 910813 | 6/1946 | France . | |
| 2626150 | 7/1989 | France | 36/3 B |
| 34-101702 | 7/1959 | Japan . | |
| 84-2314 | 11/1984 | Rep. of Korea . | |
| 87-2820 | 8/1987 | Rep. of Korea . | |
| 87-2821 | 8/1987 | Rep. of Korea . | |
| 91-1208 | 2/1991 | Rep. of Korea . | |
| 91-1209 | 2/1991 | Rep. of Korea . | |
| 91-1210 | 2/1991 | Rep. of Korea . | |
| 91-1211 | 2/1991 | Rep. of Korea . | |
| 142267 | 5/1920 | United Kingdom . | |

*Primary Examiner*—Steven N. Meyers
*Assistant Examiner*—Thomas P. Hilliard
*Attorney, Agent, or Firm*—Darby & Darby

[57] ABSTRACT

A footwear sole has a waterproof ventilation part secured in the midsole or the outsole, and a horseshoe-shaped shock-absorbing heel member secured in the heel portion of the sole part in which the waterproof and ventilation part is secured. The waterproof and ventilation part includes a buoyancy plate that blocks penetration of water into the sole during bad weather. The shock-absorbing heel member has opposite flanges with an empty space therebetween that insure very good shock-absorbing properties of the shock absorbing heel member.

29 Claims, 15 Drawing Sheets

FOOTWEAR SOLE PROVIDING VENTILATION, SHOCK ABSORPTION AND FASHION

This is a continuation of application Ser. No. 586,606, filed Sep. 21, 1990, now abandoned.

BACKGROUND OF THE INVENTION

1. Field of the Invention

The invention relates to varied footwear soles for sport footwear, shoes, military shoes, safety shoes, mountain-climbing shoes, etc., that have an upper. In particular, the invention relates to a footwear sole which can be fixed to the heel to provide a cushion function and to prevent penetration of water into the footwear in bad weather and which utilizes waterproof and ventilation parts applied at the front of the heel to provide good ventilation and further shock absorption.

2. Description of the Prior Art

Korean Utility Patent Publication No. 82-2591 (U.S. Pat. No. 4,499,672, Public Notice No. 80-31524 (85.9.20) of Japanese utility patent) discloses a midsole providing ventilation and shock absorption and joined to the outsole by means of projections.

The outsole has circular projections on its surface with circular projections applied at the heel having some air entry, while the midsole projections on the outskirts of its reverse side have a plurality of punched ventilation holes as on its inner side as well.

Korean Utility Patent Publication No. 82-2592 shows a footwear backsole with an air opening connected to an air passageway that was prepared on the heel.

Korean Utility Patent Publication No. 90-2356 shows a footwear sole providing ventilation and shock absorption and having a ventilation cap having a fixable connection joint cab.

The heel side part of the complementary sole has a cork layer on its surface formed as a circular curve part and, on the reverse side of it, projections for a cushion were prepared while on the front of it, a round projected part was formed as well as cushioning projections with ventilation punched holes.

The front part of the midsole has a space part with a round projected part prepared at the inner side of the outskirts.

The surface of the outsole has vertical and horizontal air inhalation and air supply passages with the front part of the air supply passage connected to the air inhalation chamber, and the joint part of the air inhalation passage has a punched ventilation hole.

Korean Utility Patent Publication No. 90-2537 discloses a footwear sole providing ventilation and shock absorption which has an airing cap fitted to its receptacle. The front part of a soft cushion midsole has punched holes while the reverse side of it has shock-absorbing projections.

The back part of the reverse side of the cushioned midsole has circular projections while the back part of the outsole has an air inhalation and exhalation opening. The projected part on the front of the heel was prepared for fitting to the airing cap which has ventilation holes and receptacles.

Further, Utility Patent Publication No. 90-2538 discloses a footwear sole providing ventilation and shock absorption and which has a heel cushioned pad on the surface of the outsole. A soft cushioned pad with a surface of a cork layer is fitted to the inside of the cut part which was prepared at the front part of a hard board midsole.

The surface of the cushioned pad was attached to the board midsole by a textile net. The reverse side of the cushioned pad has cushioned projections through which ventilation holes extend.

The reverse side of the heel cushioned pad has a curve part on its surface containing an air ventilation chamber and an air supply passage.

The inner part of the air inhalation chamber has shock-absorbing projections.

The projected part of the air inhalation and exhalation opening means that lead to the ventilation chamber and the air supply passage has punched ventilation holes and an airing cap having hollow joints fitted to the outsole.

The above-described technology allows good ventilation within footwear as the airing cap has ventilation holes but can not effectively prevent water from getting into the footwear in bad weather.

In addition, the shock-absorbing material at the heel is not fitted in the inside of the heel of the sole, and the effective shock absorption at the heel of the sole cannot be expected.

Further, the fact that the cushioned shock-absorbing material for the heel is not fitted at a texon board does neither afford good shock-absorbing effect to the backside of the foot nor remove the negative factors for the shock absorption, in case of the sole of footwear having a heel, such as that of shoes, military shoes, safety shoes and mountain-climbing shoes, due to the hard iron for waist fitted at the texon board.

SUMMARY OF THE INVENTION

An object of the invention is to eliminate the above-mentioned drawbacks and provide a sole that effectively absorbs shocks at the backside of the foot and with the midsole fitted into the backside of the footwear.

The midsole may include different horseshoe-shaped shock-absorbing members with excellent elasticity. The horse-shoe-shaped shock-absorbing members are located in the heel of the outsole in the case of shoes.

The inside of the shock-absorbing members for the foot heel is hollow, but the sectional parts of both sides form closed pipe-shaped elements.

In the shock-absorbing members with pipe-shaped elements, the elements have a flange at the upper and lower portions facing outside which can cushion the shock to the backside of the foot during walking.

The shock-absorbing members at the heel are horse-shoe-shaped. The sectional part of the inside is closed while the sectional part of the unit facing outside forms a plural layer of an opened circular arc or has a hexagonal shape.

According to the invention, a buoyancy plate fitted inside the waterproof and ventilation part prevents water from getting into the sole in bad weather by being raised due to buoyancy which closes the inhalation and exhalation opening leading to the sole.

Further, according to the invention, lowering of the buoyancy plate due to an exhausting force when the air in the sole is exhausted causes water exhaust in the waterproof and ventilation part through the ventilation port.

DESCRIPTION OF THE PREFERRED EMBODIMENTS

The invention will now be described with reference to the attached figures.

Figure 1:
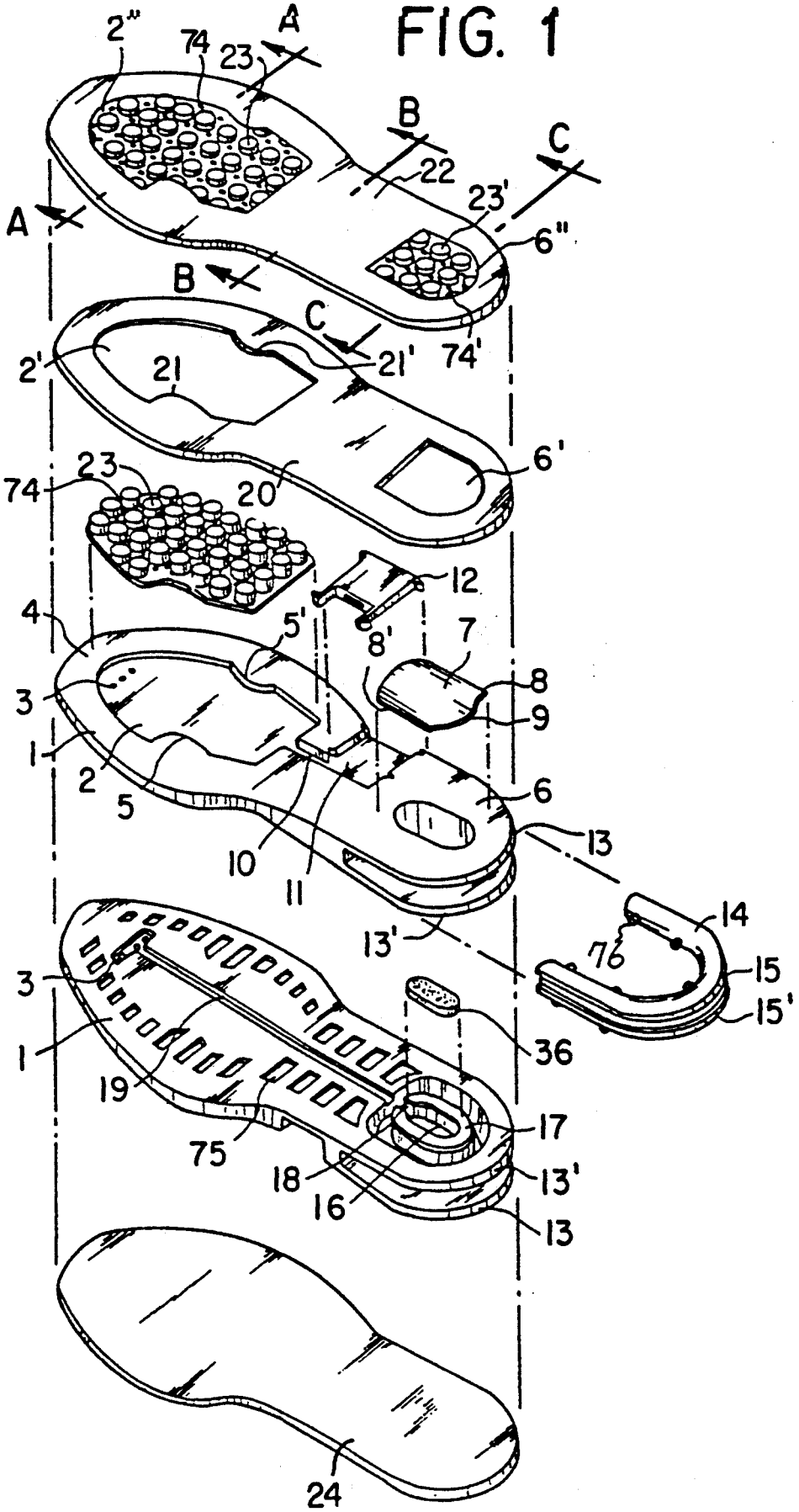
FIG. 1 is an exploded view of a footwear sole with a flat bottom for a sport footwear.

FIG. 1 shows a footwear sole for use in sport shoes. The front part surface of the midsole (1) has an air ventilation chamber (2) and punched ventilation holes (3).

There are two circular arc-shaped elements (5)(5') on the outskirts of the air ventilation chamber (2). The rear portion of the midsole (1) has a round receiving chamber defined by a circular arc-shaped plate (6).

A rear cushion shock-absorbing element (9) linked to a flange (8)(80') is fitted into both sectional parts of the arc-shaped plate.

The air passage (10) leading to the receiving groove (11) extends between the air chamber (2) and the rear cushion shock-absorbing element on the surface of the midsole.

A waterproof and ventilation part (12) is fixed in a receiving groove (11) and a horseshoe-shaped shock-absorbing heel member (14) is fixed between the upper flap and the lower one of the rear portion of the midsole. The member (14) constitutes a body corresponding in shape to the midsole.

The flanges (15)(15') are formed between the upper part and the lower one of the outskirts of the back shock-absorbing member.

In the rear portion of the midsole, an air compression chamber is formed by a circular wall (17) having a shape similar to that of the heel shock-absorbing member.

The front of the wall (17) has an air passage (18).

The passage is linked with a ventilation passage (19) which leads through the central part of the midsole.

The ventilation passage (19) is connected with ventilation holes (3), and air cavities (75) are formed outside the ventilation passage (19).

On the board (20), the air ventilation chamber 25 (2') and a round receiving chamber (6') corresponding to those of the midsole (1) are also provided, forming two circular arc-shaped portions.

An air ventilation chamber (2") and a round receiving chamber (6") on the insole (22) have cushion air bags (23) (23'). The length of their reverse sides is such that the lower sectional part of the cushion air bags (23)(23') may contact the air ventilation chamber (2) of the midsole (1) and the rear cushion shock-absorbing element (7) when the board (20) and the insole (22) are fixed on the surface of the midsole (1), and the outsole (24) is fixed on the reverse side of the midsole (1).

The round wall (17') and the air compression chamber (16') may hold a deodorizing agent and a sponge agent (36)(37) containing perfume.

Figure 2:
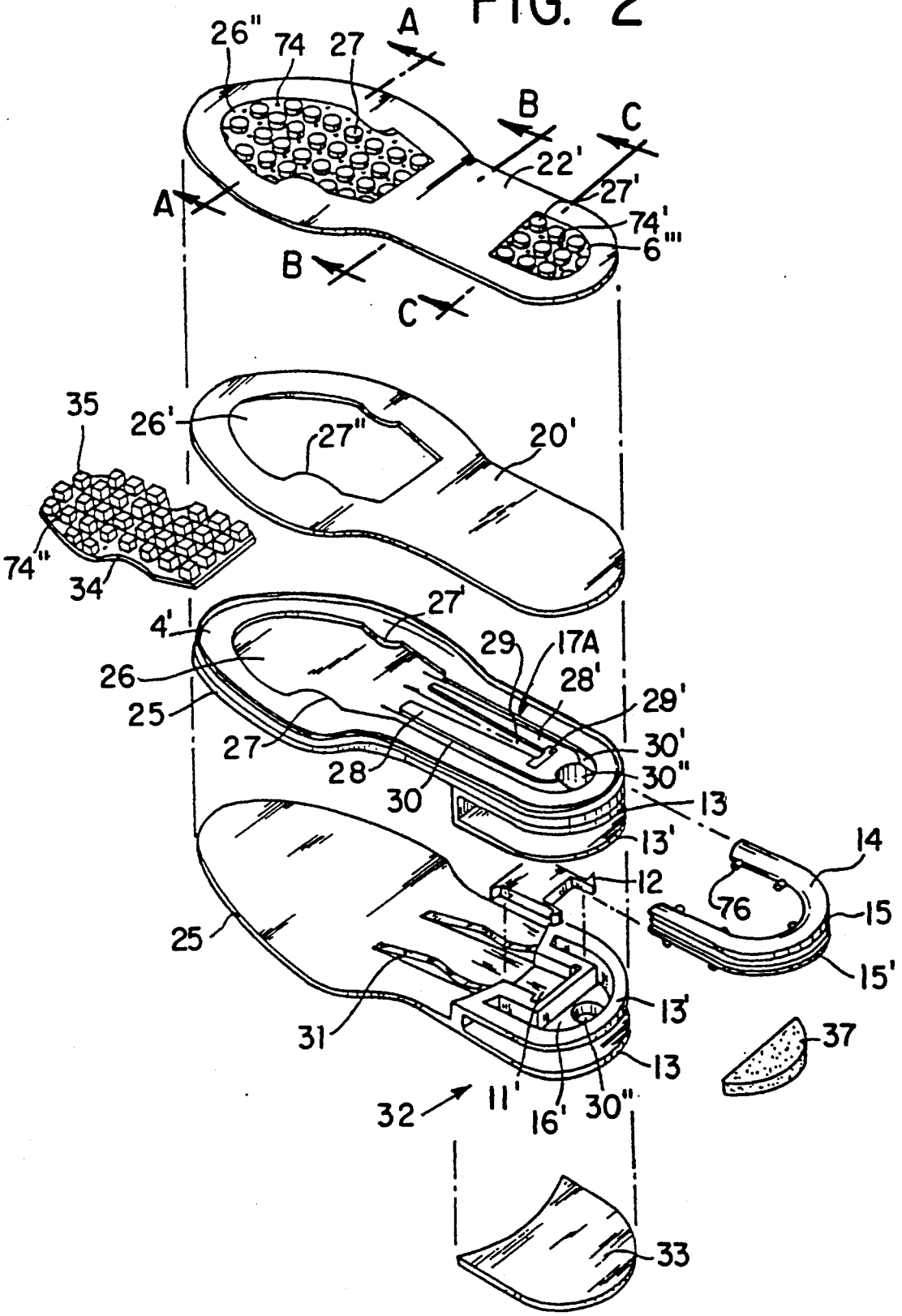
FIG. 2 is an exploded view of a footwear sole with a heel for leather shoes, safety shoes, military shoes, and mountain-climbing shoes.
Figure 3:
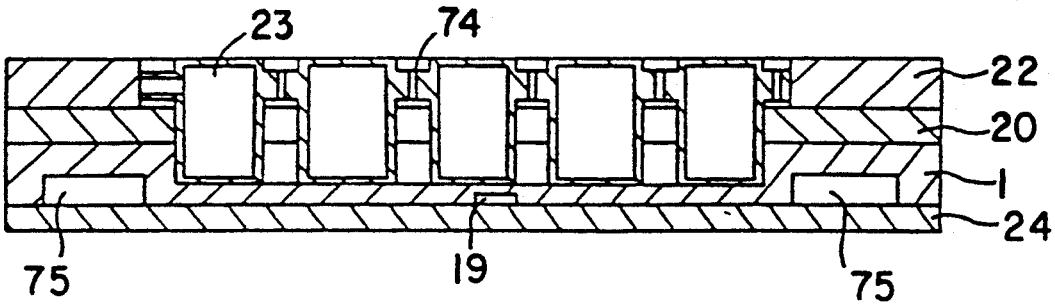
FIG. 3 is an enlarged sectional view along A—A line of FIG. 1.
Figure 4:
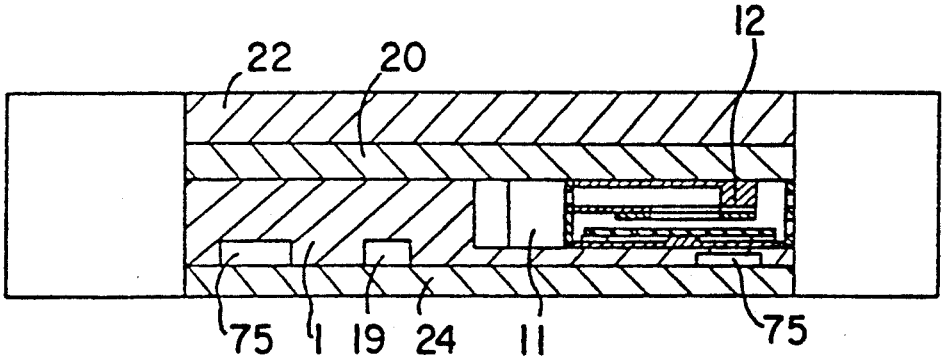
FIG. 4 is an enlarged sectional view along B—B line of FIG. 1.
Figure 5:
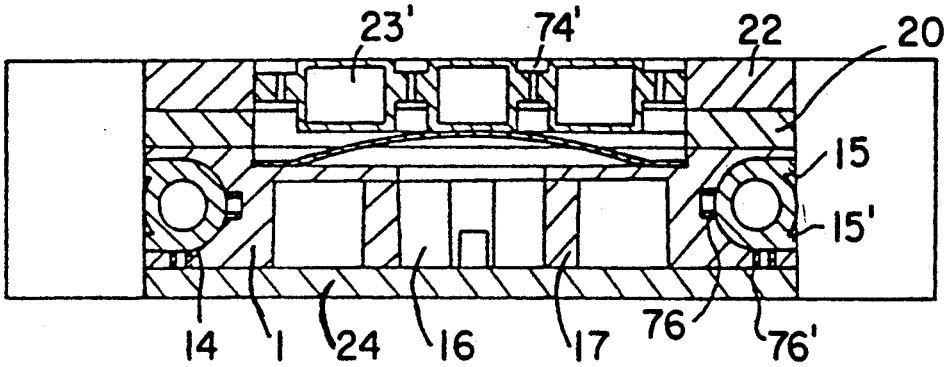
FIG. 5 is an enlarged sectional view along C—C line of FIG. 1.
Figure 6:
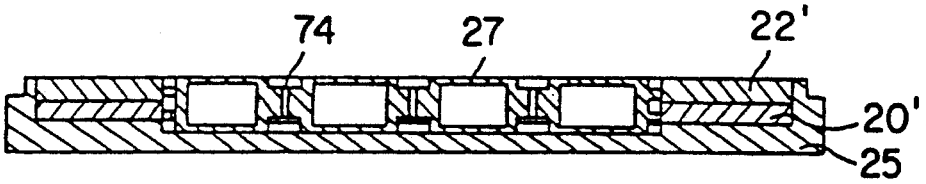
FIG. 6 is an enlarged sectional view along A—A line of FIG. 2.
Figure 7:
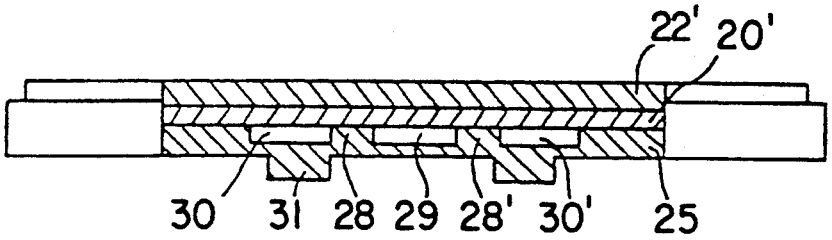
FIG. 7 is an enlarged sectional view along B—B line of FIG. 2.
Figure 8:
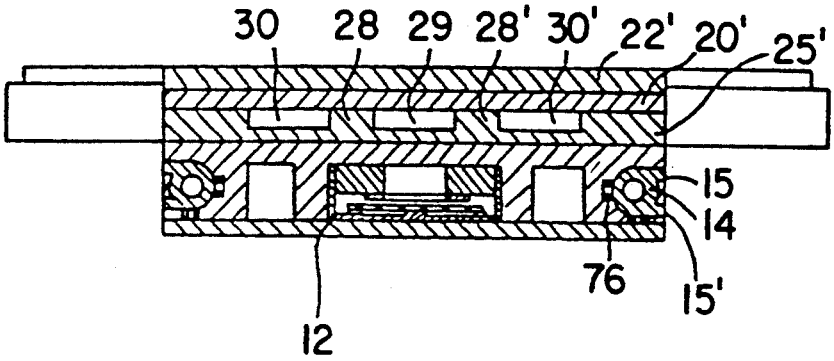
FIG. 8 is an enlarged sectional view along C—C line of FIG. 2.

FIG. 2 shows a footwear sole used in shoes, military shoes, safety shoes and mountain-climbing shoes having a back heel. The front part surface of the outsole (25) has an air ventilation chamber (26) and two circular arc-shaped elements (27)(27') on the outskirts (4') of the air ventilation chamber (26).

The rear portion of the outsole (25) has ventilation walls (28)(28') as high as the outskirts. The exhaust passage (29) is formed between the ventilation walls (28)(28') while the air supply passage (30) is located outside the ventilation walls (28)(28').

One portion of the exhaust passage (29) is connected to the exhaust hole (29') while one portion of the air supply passage (30)(30') is connected to the air supply hole (30''), respectively. The shank part (25') on the reverse side of the outsole (25) has a projected waist part (31) serving as a stiffening rib, and the rear heel part (32) has a receiving groove (11').

The waterproof and ventilation part (12) is fixable in the receiving groove (11'), while the horseshoe-shaped shock-absorbing member (14) forming a body corresponding to the heel part (32) is fitted between upper (13) and lower (13') flaps of the outsole (25).

The upper and lower parts of the rear shock-absorbing member (14) have flanges (15)(15') and the flat sole (33) is fixed to the reserve side of the heel part (32).

The air ventilation chamber (26') is also formed in the board (20') corresponding in shape to the outsole (25).

The circular arc-shaped element (27'') extends into the air ventilation chamber (26'). The insole (22') has an air ventilation chamber (26'') and receiving chamber (6'') corresponding to those of the board (20').

The air ventilation chamber (26'') and the receiving chamber (6'') have cushion air bags (23)(23').

The length of its reverse side is so formed that the lower sectional part of the cushion air bags (23)(23') may contact the bottom of the air ventilation chamber (26) of the outsole (25) and the surface of the board (20').

In FIG. 1, the cushion air bags (23) in the ventilation chamber (2) of the midsole may displace those in the ventilation chamber (2'') of the insole.

In FIG. 2, the cushion pad (34) with cushion projections (35) and ventilation holes (74'') may be optionally located in the air ventilation chamber (26) of the outsole.

Figure 9A:
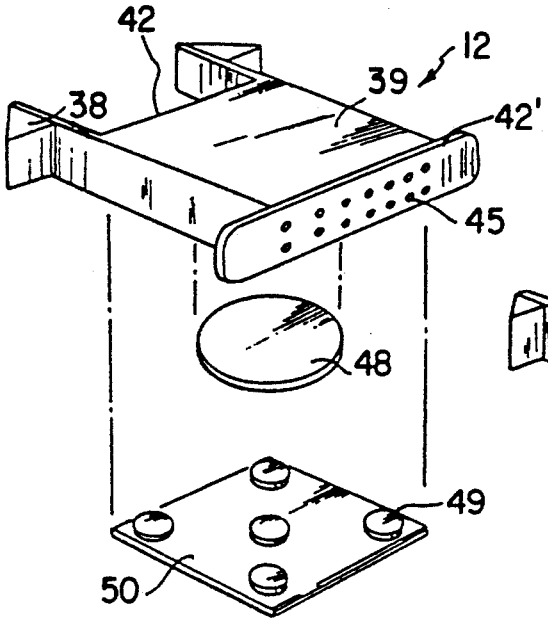
FIG. 9A is an exploded view of a ventilation and waterproofing part according to the invention.
Figure 9B:
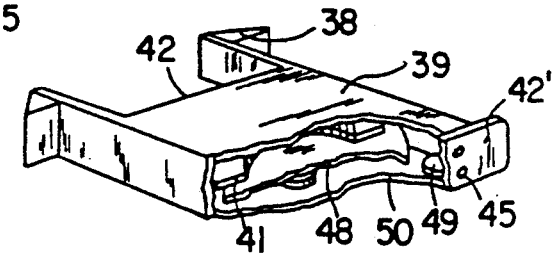
FIG. 9B is a partially cut-off perspective view of the ventilation and waterproofing part.
Figure 9C:
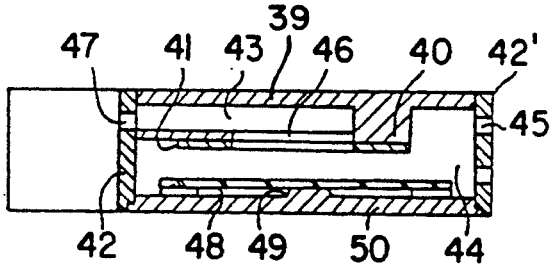
FIG. 9C is an enlarged vertical sectional view of the ventilation and waterproofing part.
Figure 10A:
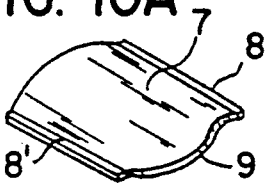
FIG. 10A is an enlarged perspective view of the cushion member.
Figure 10B:
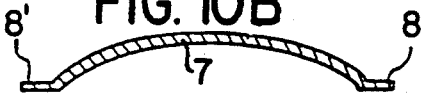
FIG. 10B is a sectional view of the cushion member.
Figure 11:
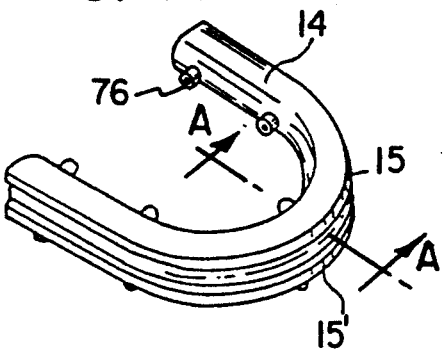
FIG. 11 is a perspective view of a shock-absorbing member used with a midsole according to the invention.
Figure 12:
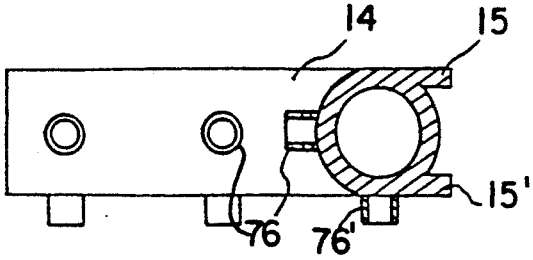
FIG. 12 is an enlarged sectional view along line A—A of FIG. 11.
Figure 13A:
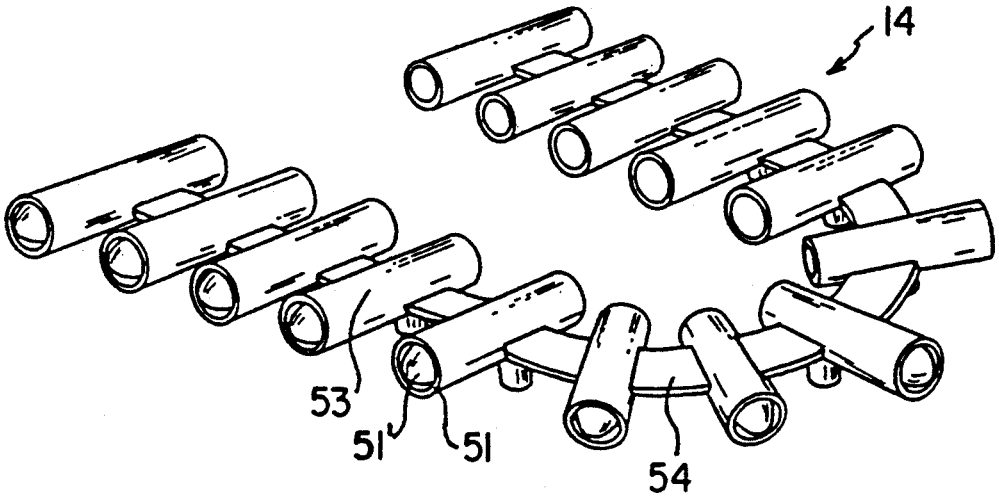
FIG. 13A is a perspective view of one embodiment of a shock-absorbing heel member according to the present invention.
Figure 13B:
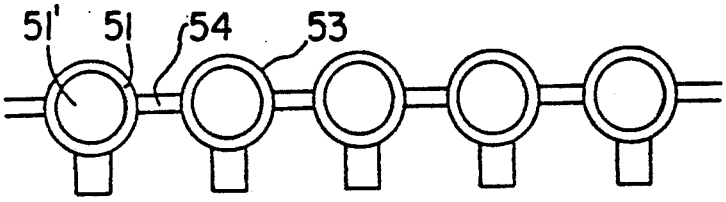
FIG. 13B is an enlarged partial side view of the shock-absorbing heel member shown in FIG. 13A.
Figure 13C:
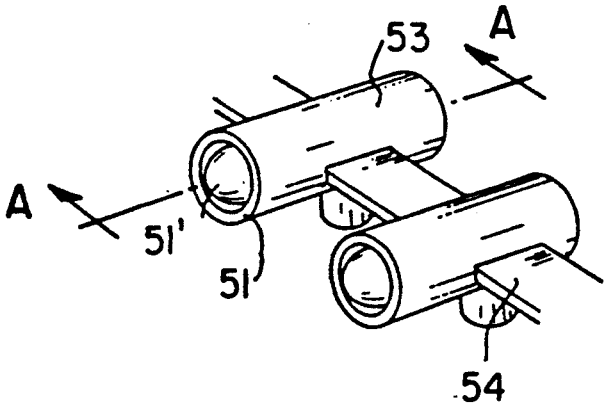
FIG. 13C is an enlarged perspective view of a portion of the shock-absorbing heel member shown in FIG. 13A.
Figure 13D:
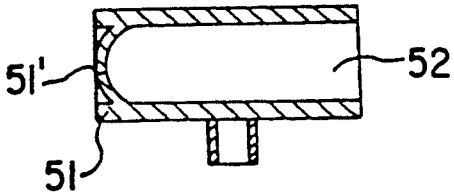
FIG. 13D is a sectional view along line A—A of FIG.
Figure 14A:
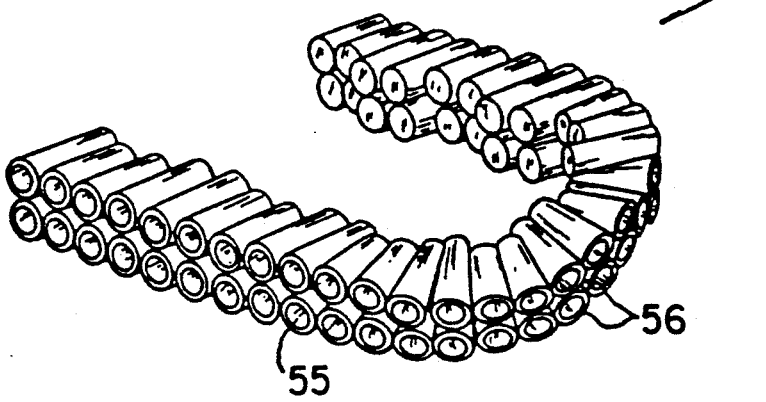
FIGS. 14A-14D, 15A-15D and 21A-21D are views similar to those of FIGS. 13A-13D of other embodiments of shock-absorbing heel members according to the invention.
Figure 14B:
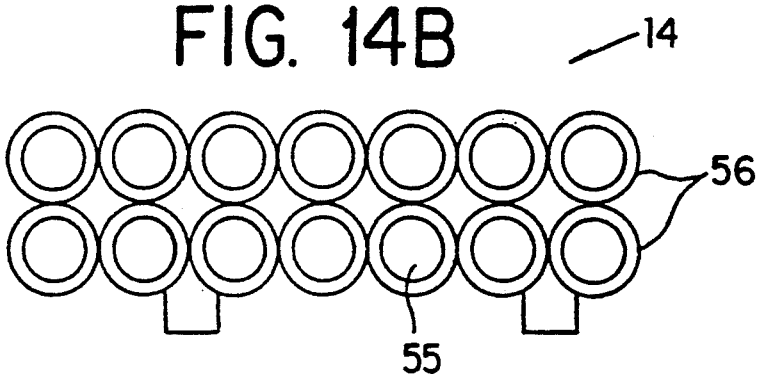
Figure 14C:
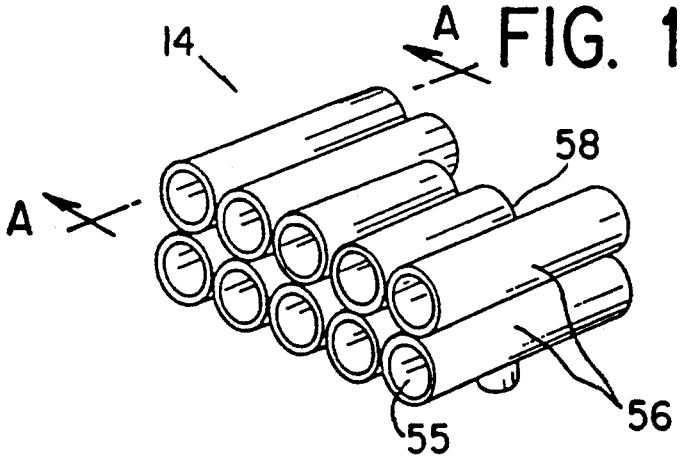
Figure 14D:
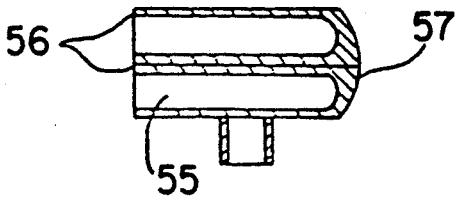
Figure 15A:
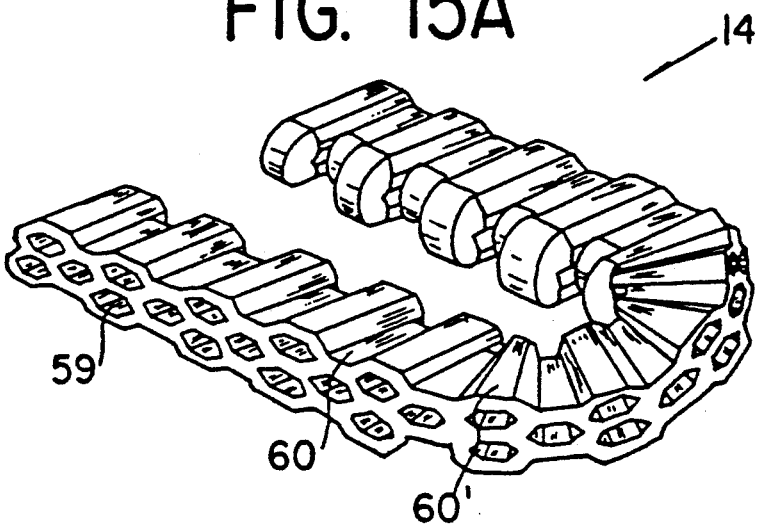
Figure 15B:
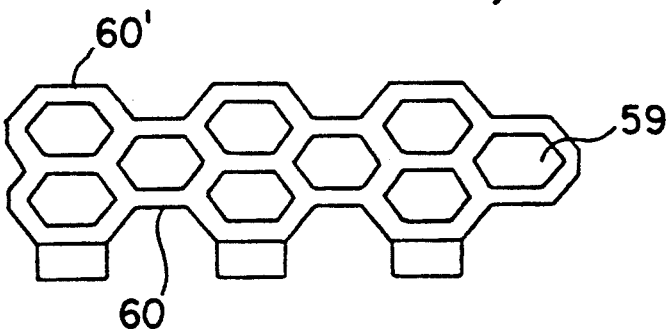
Figure 15C:
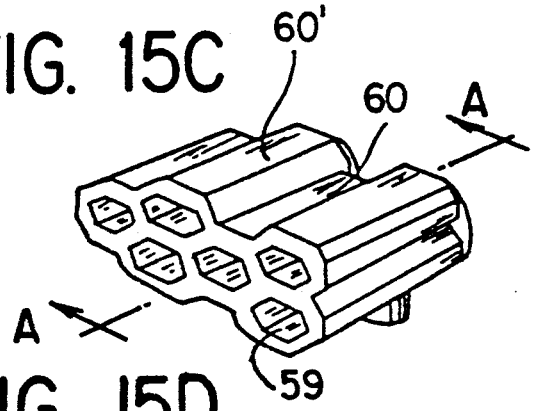
Figure 15D:
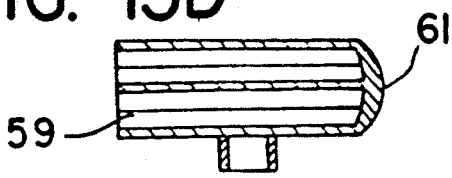
Figure 16A:
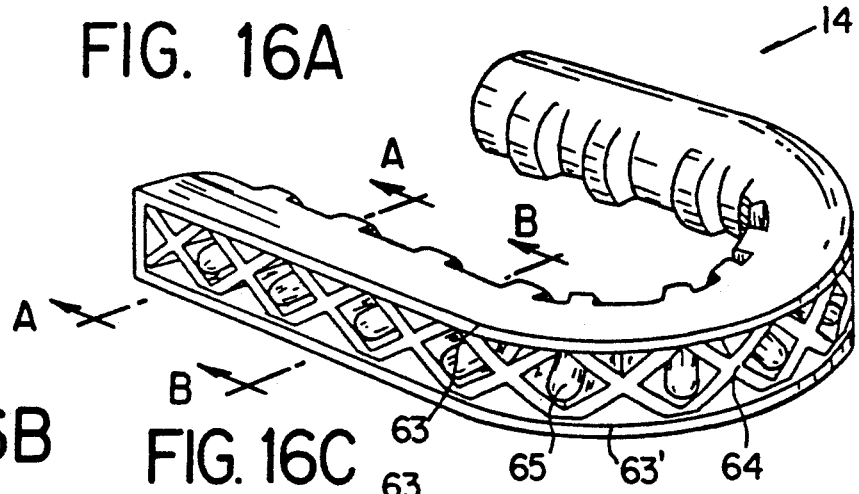
FIG. 16A is a perspective view of another embodiment of the shock-absorbing heel member according to the invention.
Figure 16B:
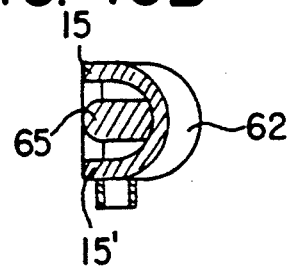
FIGS. 16B and 16C are sectional views along lines A—A and B—B, respectively, of FIG. 16A.
Figure 16C:
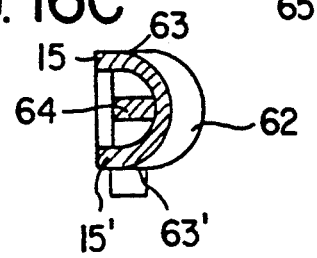
Figure 17A:
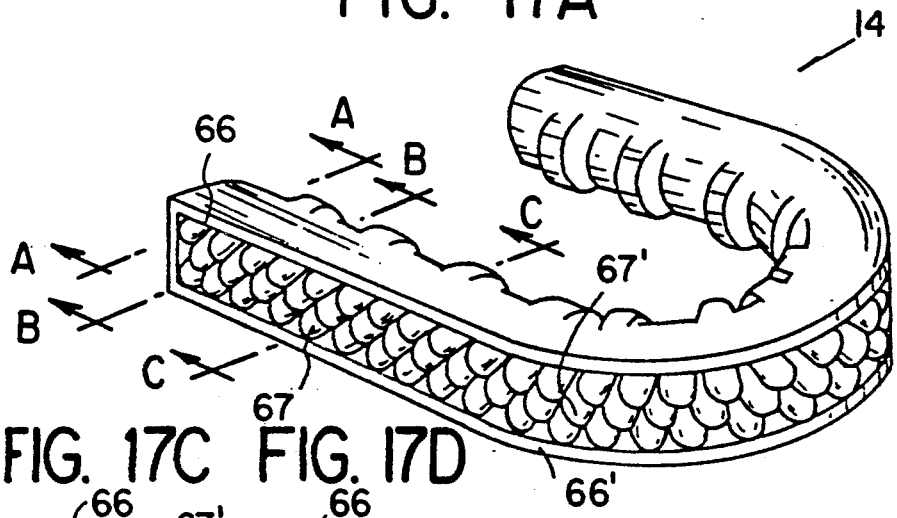
FIGS. 17A-17C, 18A-18C and 19A-19C are views similar to those of FIGS. 16A-16C of further embodiments of a shock-absorbing heel member according to the present invention.
Figure 17B:
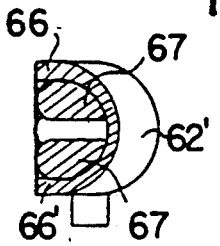
Figure 17C:
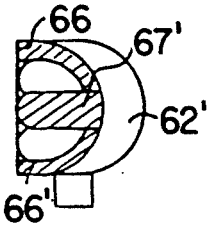
Figure 17D:
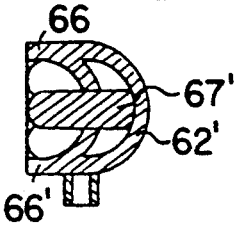
FIG. 17D is a sectional view along line C—C of FIG. 17A.

The waterproof and ventilation part (12) shown in detail in FIG. 9, constitutes a rectangular box-shaped body with holding joint means (38).

In the center of the reverse side of the upper plate (39) of the part (12), a small tubular part (40) extends vertically, and half of this part (40) is cut and closed at the backwall (42) of the body by a wall of inhalation and exhalation chamber (41).

Due to the partition of the wall (42) of inhalation and exhalation chamber (41), a ventilation chamber (43) and a water-receiving chamber (44) are formed in the waterproof and ventilation part (12).

The water-receiving chamber is connected to the ventilation opening (45) of the front wall (42') and the tubular part (40).

The inhalation and exhalation opening (46) of the pipe and the ventilation chamber (43) is connected to the ventilation part of the rear wall (42).

Under the tubular part (40), the bottom of the box-shaped body is closed with an outer plate (50) which has separate upwardly extending projections (49) for a buoyancy plate (48).

FIG. 13-26 are views showing different types of shock-absorbing heel members.

The shock-absorbing heel members are made of saturated resin or rubber with good elasticity. Being of a long form, they are all formed as a horseshoe-shaped hoof to be fixed in the midsole (1) of a sport footwear or the outsole of shoes and different soles of other footwear.

The shock-absorbing heel member (14) of FIGS. 13A-13D comprises a plurality of hollow pipes (53) connected with connecting bands (54). The inner end (52) of pipes (53) is open while the outer end is provided with a flange (51) and a circular arc-shaped projection (51').

The shock-absorbing heel member (14) of FIGS. 14A-14D comprises a hollow element (55) consisting of two rows of cylinders (56) closed at the inner ends thereof.

The shock-absorbing heel member (14) of FIGS. 15A-15D is formed of a plurality of duplicated hexagonal bodies (60') forming a hollow part (59) with hexagonal bodies (60) between bodies (60'). The hexagonal bodies (60') are closed at the inner side thereof with an inner arcuate part (61).

The shock-absorbing heel member (14) of FIGS. 16A-16D is formed so that the inside hollow cavity thereof is partitioned by a wall (64) arranged between the upper and lower walls (63) (63'). The cavity defined by spaced walls (63)(63') is closed by a circular arc (62). The wall (69) supports a plurality of internal mandrels (65). The outer end portions of the upper and lower walls (63)(63') form flanges (15) (15').

The shock-absorbing heel member of FIGS. 17A-17D is somewhat similar to that of FIGS. 16A-16D with the internal mandrels (67) (67') provided between the upper and lower walls (66)(66') and whose inner end is closed by a circular arc (62').

Figure 18A:
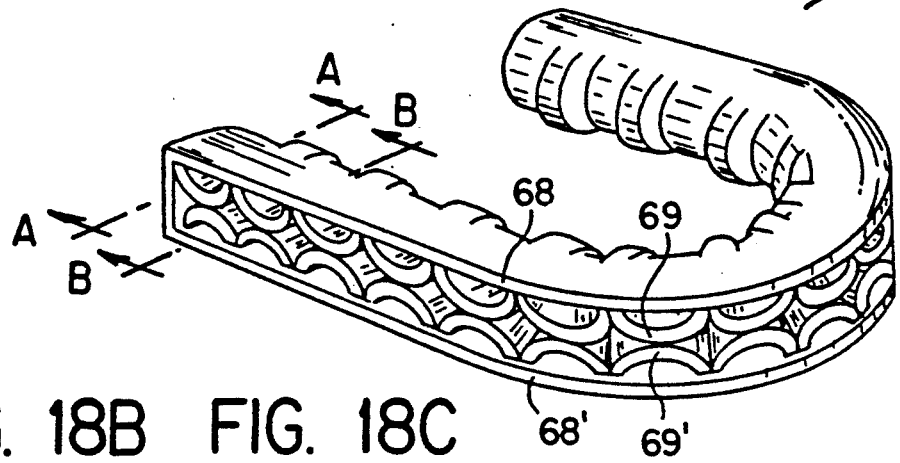
Figure 18B:
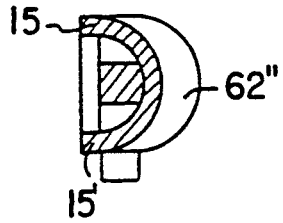
Figure 18C:
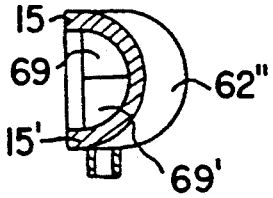

The shock-absorbing heel member of FIGS. 18A-18C is formed so that the half-ring bodies (69)(69) are provided between the upper and lower walls (68)(68'), and the outer end portions of the upper and lower walls (68)(68') form flanges (15)(15').

Figure 19A:
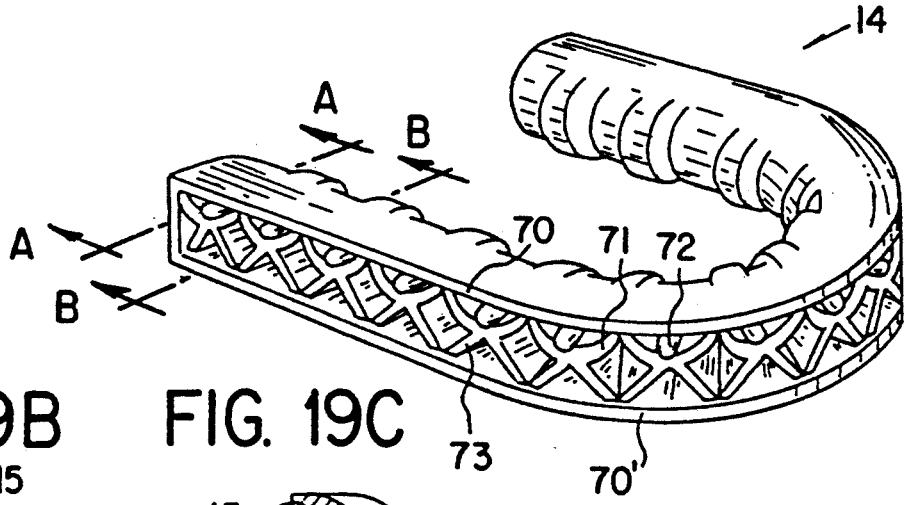
Figure 19B:
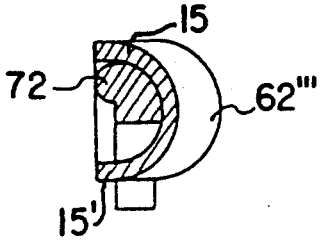
Figure 19C:
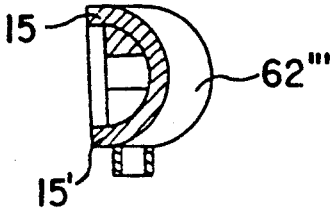
Figure 20A:
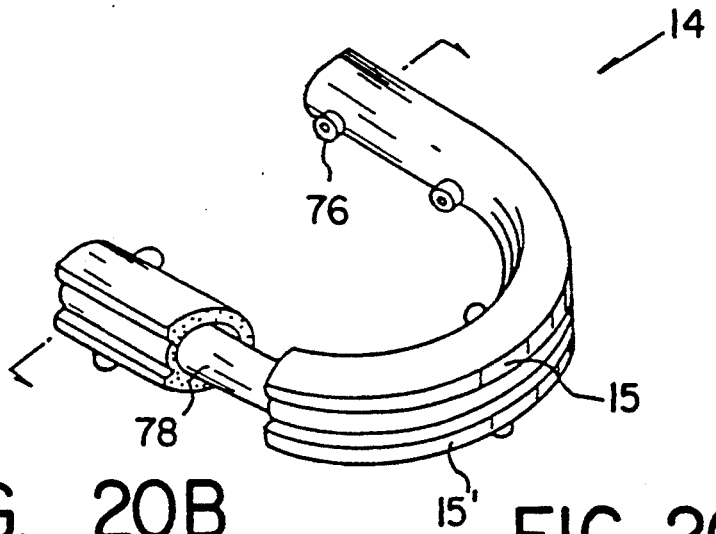
FIG. 20A is a perspective partially cross-sectional view of still another embodiment of a shock-absorbing heel member according to the present invention.
Figure 20B:
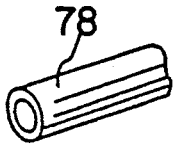
FIG. 20B is a perspective partial view of a pipe member forming a part of the shock-absorbing heel member of FIG. 20A.
Figure 20C:
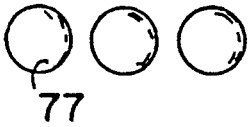
FIG. 20C is a perspective view of a plurality of ball members comprised in the shock-absorbing heel member of FIG. 20A.
Figure 20D:
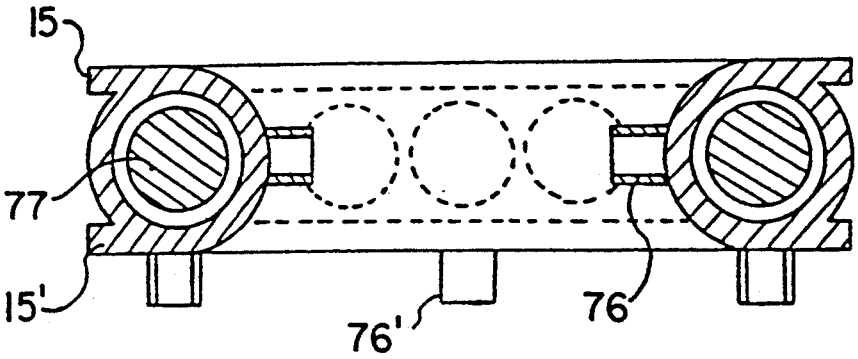
FIG. 20D is a sectional view along line A—A of FIG. 20A.
Figure 21A:
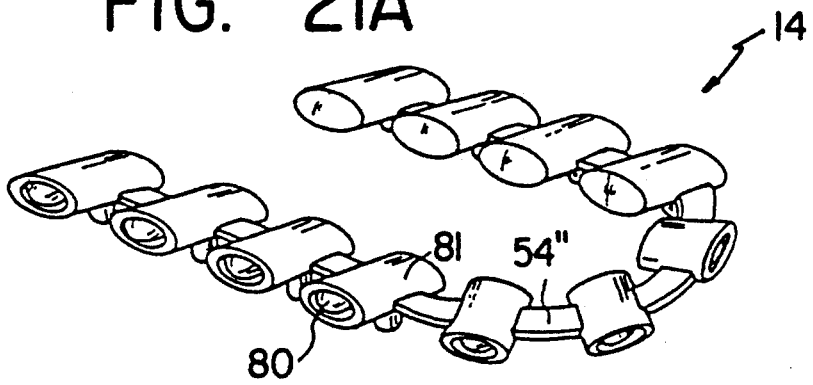
Figure 21B:
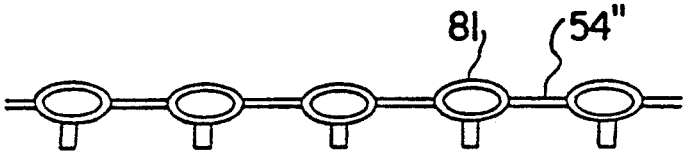
Figure 21C:
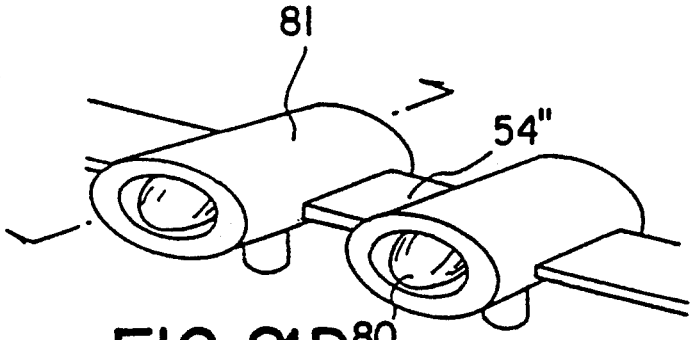
Figure 21D:
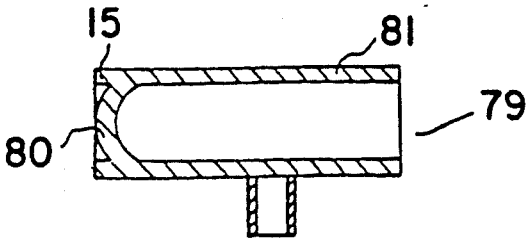

The shock-absorbing heel member (14) of FIGS. 19A-19C is formed so that it comprises a plurality of half-ring bodies (71) and a plurality of internal mandrels (72) supported between the upper wall (70) and the lower wall (70') of which the internal ends are closed by a circular arc (62''). The lower part of the half-ring bodies (71) has supporting bodies (73). The external end portions of the upper and lower walls (70)(70') form flanges (15)(15').

The shock-absorbing heel member (14) of FIGS. 20A-20D is formed so that the horseshoe-shaped shock-absorbing heel member (14) has flanges (15)(15') on the upper and lower part of the external outskirts with tubular bosses (76)(76'), respectively.

The heel member (14) contains elastic balls (77) or a pipe (78).

The shock-absorbing heel member (14) of FIGS. 21A-21D is formed so that its hollow element consists of a plurality of oral pipe sections (81) connected with bands (54''). The outer ends of pipe sections (81) are closed with circular arc-shaped elements (80) and defined therewith flanges (15).

Figure 22A:
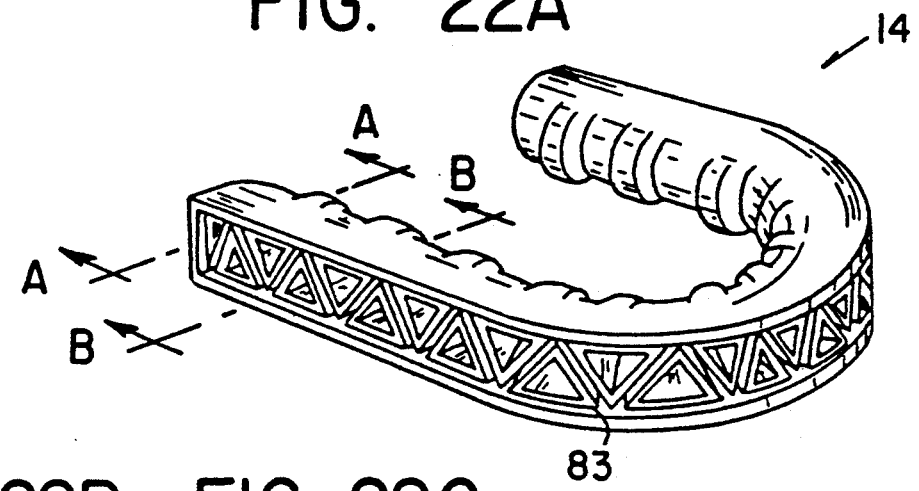
FIGS. 22A-C, 23A-23B, 24A-24B, 25A-25B and 26A-26B are perspective and respective transverse sectional views of still further embodiments of a shock-absorbing heel member according to the present invention.
Figure 22B:
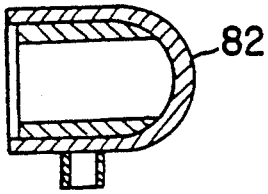
Figure 22C:
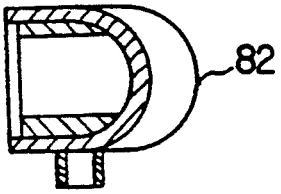

The shock-absorbing heel member (14) of FIGS. 22A-22C is formed so that the internal cavity thereof defined by upper and lower walls, is closed by circular arcs (82) and includes triangular bodies in alternating upright and upside-down positions. The member has a horseshoe shape.

Figure 23A:
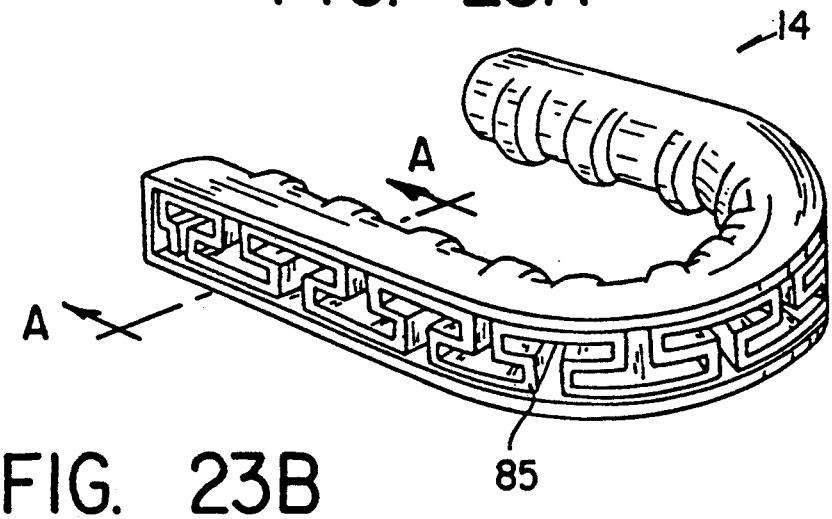
Figure 23B:
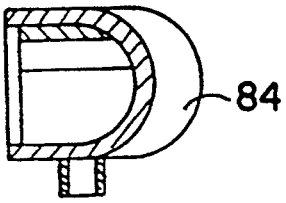

The shock-absorbing heel member (14) of FIGS. 23A-23B is formed so that the internal cavity defined by upper and lower walls is closed by circular arcs (84) and includes alternating upright and upside-down T-shaped bodies. The member has a horseshoe shape.

Figure 24A:
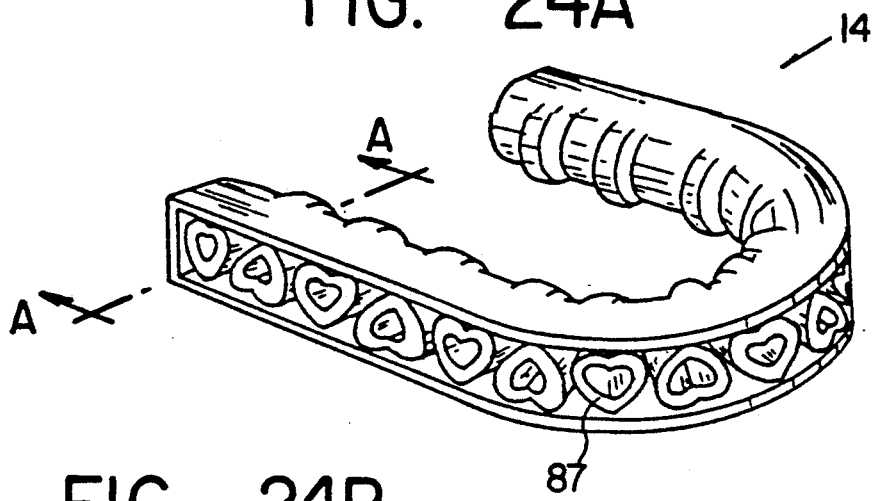
Figure 24B:
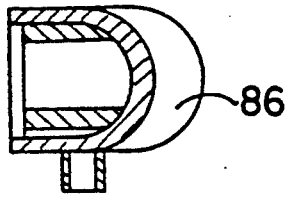

The shock-absorbing heel member (14) of FIGS. 24A–24B is formed so that the internal cavity thereof defined by upper and lower walls is closed by circular arcs (86) and contains alternating upright and upside-down heart-shaped bodies (87). The member has a horseshoe shape.

Figure 25A:
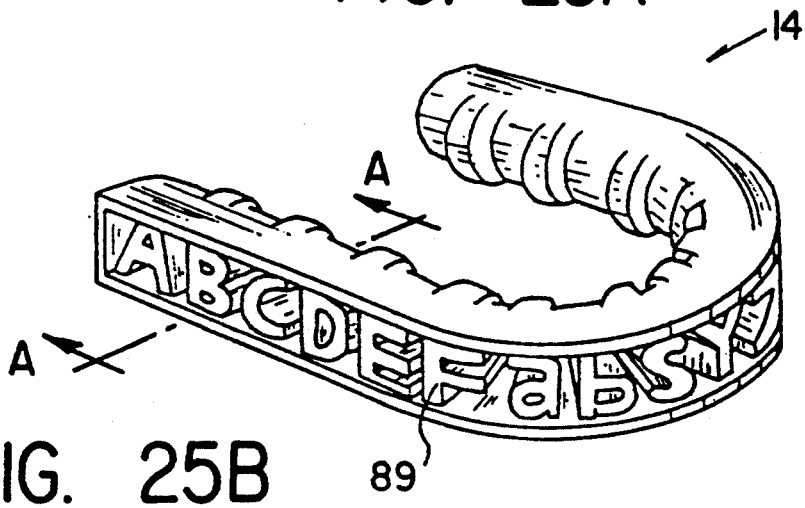
Figure 25B:
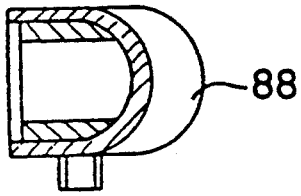

The shock-absorbing heel member (14) of FIGS. 25A–25B is formed so that the internal cavity thereof defined by upper and lower walls is closed by circular arcs (88) and the elastic alphabet-shaped bodies (89) are located between the upper and lower walls.

Figure 26A:
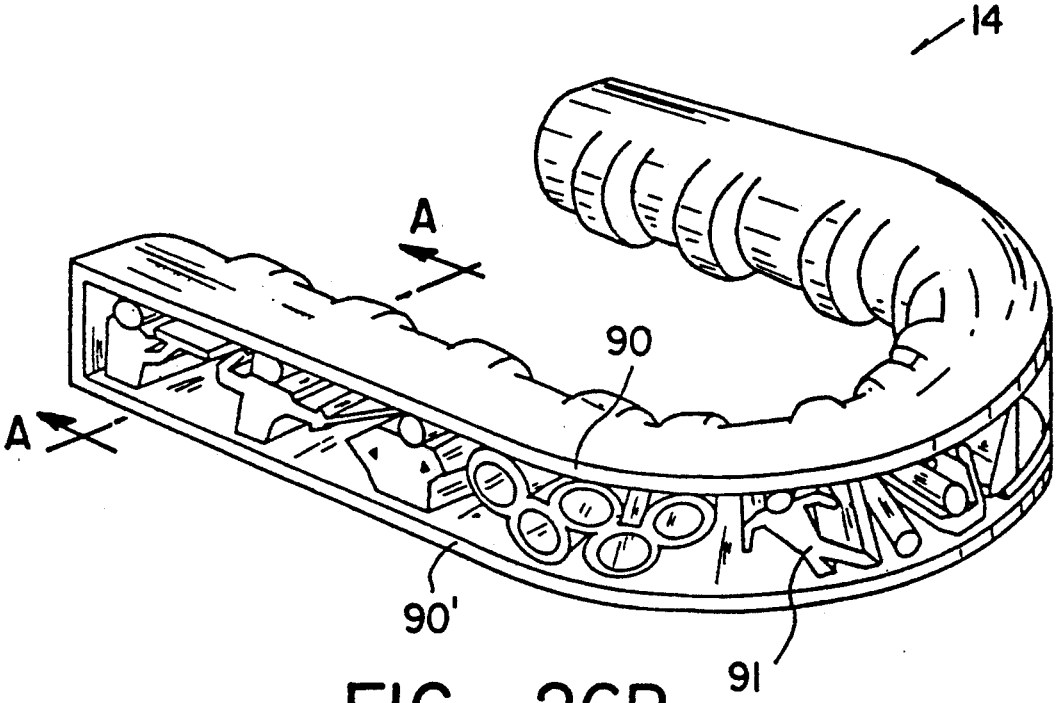
Figure 26B:
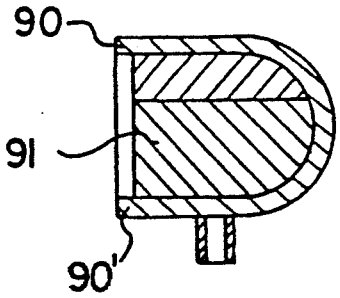

The shock-absorbing heel member (14) of FIGS. 26A–26B is formed so that the internal cavity thereof defined by upper and lower walls is closed by circular arcs (90) and the elastic Olympic marks and the figures (91) of sportsmen are located between the upper wall (90) and lower one (90').

Reference numerals (74) and (74') designate ventilation holes punched on the sheet of the cushion air bag, and reference numerals (76) and (76') are supporting parts for the forming groove of a mold which is used when the shock-absorbing heel member (14) is fixed to the heel part of the midsole (1).

The sole of the invention is assembled as follows:

In FIG. 1, the shock-absorbing heel member (14), first of all, is fixed between the upper flap (13) and the lower one (13,) of the midsole (1), and the waterproof and ventilation part (12) is fixed in the receiving groove (11).

The ventilation port (47) at the rear wall (42) of the waterproof and ventilation part (12) is to be connected to the air passage (10).

As the ventilation openings (45) punched on the front wall (42'') of the waterproof and ventilation part (12) faces the outside of the midsole, the air from the outside can be introduced into the ventilation openings (45).

The air is conducted through the ventilation chamber (43) via the inhalation and exhalation opening (46) and passes into the air passage (10) through ventilation port (47). The air passes into the ventilation holes (3) of the air ventilation chamber (2) and then reaches the air compression chamber (16) through the ventilation passage (19) on the reverse side of the midsole (1).

The satisfactory air-inhalation stated above can be made when the outsole (24) is fixed to the reverse side of the midsole (1) with the cushioned shock-absorbing means (9) fixed on the surface of the midsole so that the middle of the receiving chamber (6) takes a circular arc shape and the board (20) is also fixed with the insole (22) fixed on the surface of the texon board.

The process of the air-exhalation is undergone vice versa.

In case of sport shoes, as well as boots, military shoes and safety shoes, etc., it is desirable that the footwear shoe has shock-absorbing means on the heel as the back part of the foot receives much shock during normal walk and exercise.

To this end, the shock-absorbing heel member (14) that is horseshoe-shaped and has the upper and lower flanges (15) (15'), is fixed in the rear portion of the footwear sole in this invention, and the arc-shaped cushion shock absorbing means (9) is fixed with flanges (8) (8') in the receiving chamber and further, at the reverse side of it the air compression chamber (16), is formed in the wall (17).

Due to the construction described above, the hollow shock-absorbing heel member (14), in walk, is contracted and with the upper and lower flanges (15)(15') receiving load, the air in the air compression chambers (16) moves toward the front portion due to the contraction of the wall (17).

In this way, the heel part of the sole can absorb the shock ideally and the shock transmitted to the rear portion of the foot is so small that the fatigue feeling due to the shock from footwear can be eliminated.

The cushion air bags (23)(23') can be fitted in the insole (22) as well, and the air compression in the cushion air bags (23)(23') can not only absorb the shock, but also provide an elastic effect due to the elasticity of the cushion air bags.

The shock to the sole of a foot can be eliminated by means of air pockets (75).

In the waterproof and ventilation part (12), the buoyancy plate (48) is put on the projections (49) and does not cause any trouble in terms of air ventilation in good weather while, in bad weather, the water penetrating through the ventilation openings of the front wall (42') remains on the outplate (50) of the waterproof and ventilation part (12), and the buoyancy plate (48) is buoyant and rises.

The risen buoyancy plate (48) closes the lower part of the inhalation and exhalation opening (46), which makes waterproofing possible as water in the water-receiving chamber (44) of the waterproof and ventilation part (12) can not get into the inhalation/exhalation opening.

On the other hand, water in the water-receiving chamber (44) lowers the buoyancy plate (48) with the air in the sole of footwear exhaled.

Accordingly, with the air filling the upper part of the water-receiving chamber (44) forces the water out. Water in the chamber (44) is exhaled through the ventilation openings (45) to provide effective waterproofing.

In FIG. 2, as well in FIG. 1, the horseshoe-shaped shock-absorbing heel member (14) is to be fixed between the upper and lower flaps (13)(13') of the heel portion of the outsole (25) and the waterproof and ventilation part (22) is to be fixed in the receiving groove of the heel part on the reverse side of the outsole.

With the front wall (42') facing the front of the footwear sole and the rear wall (42) facing the opposite part of it, the ventilation port (47), the ventilation hole (29') and the exhaust passage (29) are to be connected to the air ventilation chamber (26), while the air compression chamber on the reverse side of the outsole (25), air supply hole (30''), and the air supply passages (30)(30') are to be connected to the air ventilation chamber (26) separately.

In landing, the air in the air compression chamber (16') that is compressed due to the contraction of the shock-absorbing heel member (14) of the heel part (32) passes into the air ventilation chamber (26) through the air supply hole (30'') and the air supply passages (30)(30').

Then, the air in the air ventilation chamber (26) compressed by the sole of the foot passes through the exhaust passageway (29) and the ventilation hole (29') and is exhausted through the inner ventilation port (47) and the external ventilation openings (45) of the waterproof and ventilation part (12).

With the cushion air bag (23) and the shock-absorbing heel material restored, the external air is introduced into the inside of the footwear and vice versa.

The effect from the function of the ventilation part (12) and the cushion air bags (23)(23') and the shock-absorbing heel member (14) of the insole is the same as the case of sport shoes in FIG. 1.

Especially, the waist part fitted on the outsole of the footwear having a rear heel, as in the case of boots, military shoes, safety shoes and mountain-climbing shoes, can remove the problems hindering shock-absorption due to fitting a steel element in texon board.

In addition, the waist part (31) can perform the function of the steel element usually fitted at waist portion.

What is claimed is:

1. A footwear sole comprising:

a sole member having a heel portion at one end, said heel portion being made of a thick material formed with a recess extending inwardly from the perimeter of said one end so as to define spaced upper and lower flaps;

a substantially horseshoe-shaped, shock-absorbing heel member secured in the recess of the heel portion between the flaps, the shock-absorbing heel member having spaced upper and lower walls abutting the upper and lower flaps, respectively, said upper and lower walls having outer end portions defining respective outer end surfaces which are flush with the outer periphery of the upper and lower flaps, and having an at least partially hollow space in an area of the outer end surfaces.

2. A footwear sole as set forth in claim 1, wherein the respective outer end portions define respective outer end flanges that form the at least partially hollow space.

3. A footwear sole as set forth in claim 1, wherein the shock-absorbing heel member includes elastic ball means arranged between the upper and lower walls.

4. A footwear sole as set forth in claim 1, wherein the shock-absorbing heel member comprises a plurality of pipe elements and linking band means connecting the pipe elements, each of the pipe elements having an open internal end, a circular arc-shaped part closing an external end of the each pipe element, and a circular flange extending at least up to the farthest external point of the arc-shaped part and defining the at least partially hollow space.

5. A footwear sole as set forth in claim 1, wherein said shock-absorbing heel member comprises internal wall means extending between the upper and lower walls adjacent to inner ends of side walls, and a plurality of triangular bodies arranged between the upper and lower walls in alternating upright and upside-down positions.

6. A footwear sole as set forth in claim 1, wherein said shock-absorbing heel member comprises internal wall means extending between the upper and lower walls adjacent to inner ends of side walls, and a plurality of T-shaped bodies arranged between the upper and lower walls in alternating upright and upside-down positions.

7. A footwear sole as set forth in claim 1, wherein said shock-absorbing heel member comprises a circular arc connecting the upper and lower walls at inner ends of said walls, and a plurality of heart-shaped bodies arranged between the upper and lower walls in alternating upright and upside-down positions.

8. A footwear sole as set forth in claim 1, wherein said shock-absorbing heel member comprises a circular arc for closing an internal opening defined by the upper and lower walls, and a plurality of elastic alphabet-shaped bodies arranged between the upper and lower walls.

9. A footwear sole as set forth in claim 1, wherein said shock-absorbing heel member comprises a circular arc connecting the upper and lower walls at inner ends of said walls, and a plurality of elastic Olympic marks and figures of sportsmen arranged between the upper and lower walls.

10. A footwear sole as set forth in claim 1, wherein said shock-absorbing heel member comprises spaced walls extending between the upper and lower walls at outer and inner ends of said walls, respectively, the respective outer end portions defining respective outer end flanges extending outwardly of the outer wall.

11. A footwear sole as set forth in claim 1, wherein said shock-absorbing heel member comprises a plurality of pipe-shaped bodies defining the upper and lower walls and linking band means for connecting the pipe-shaped bodies together, each of the pipe-shaped bodies comprising an external arc-shaped member for closing the external opening of the bodies and an outer circular flange defining the outer end portions of the outer and inner walls.

12. A footwear sole as set forth in claim 1, wherein said shock-absorbing heel member comprises two rows of hollow cylinders closed at internal ends of said cylinder with respective truncated arc-shaped elements.

13. A footwear sole as set forth in claim 1, wherein the shock-absorbing member comprises a plurality of alternatingly arranged hollow twin and single hexagonal bodies closed at internal ends of said bodies.

14. A footwear sole as set forth in claim 1, wherein the shock-absorbing heel member includes a partition wall arranged between the upper and lower walls and having a plurality of spaced openings, a plurality of circular arc-shaped members for closing the openings at internal sides of said bodies, and a plurality of mandrels extending in the openings, the respective outer end portions defining respective outer end flanges extending outwardly of the partition wall.

15. A footwear sole as set forth in claim 1, wherein said shock-absorbing heel member comprises arc-shaped means connecting the upper and lower walls at inner ends of said arc-shaped means, and a plurality of mandrels arranged between the upper and lower walls.

16. A footwear sole as set forth in claim 1, wherein the shock-absorbing member comprises a plurality of half-ring bodies arranged between the upper and lower walls, the respective outer end portions defining respective outer end flanges extending outwardly of the half-ring bodies.

17. A footwear sole as set forth in claim 1, wherein the shock-absorbing member comprises a plurality of half-ring bodies abutting at opposite ends of said bodies one of the upper and lower walls, a plurality of support bodies extending between the other of the upper and lower walls and the half-ring bodies, a plurality of mandrels received within the half-ring bodies, and arc-shaped means extending between the upper and lower walls at inner ends thereof, the respective outer end portion defining respective outer end flanges extending outwardly of the half-ring bodies.

18. A footwear sole as set forth in claim 1, wherein the shock-absorbing member includes elastic pipe-shaped means arranged between the upper and lower walls, the respective outer end portions defining respective outer end flanges extending outwardly of the pipe-shaped means.

19. A footwear sole as set forth in claim 1, wherein the sole member is one of a midsole and an outsole, said one of the midsole and outsole having a ventilation chamber, the footwear sole further comprising a waterproof and ventilation part secured in said one of the midsole and the outsole, said one of the midsole and the outsole having a groove for receiving the waterproof and ventilation part therein and air passages for allowing communication between the waterproof and ventilation part and the ventilation chamber of said one of the midsole and outsole.

20. A footwear sole as set forth in claim 19, wherein said sole member is a midsole including an arc-shaped plate defining a rear rounded receiving chamber, a rear cushion shock-absorbing member fitted within the arc-shaped plate, the groove for receiving the waterproof and ventilation part being located between the ventilation chamber and the rear cushion shock-absorbing member, an air passage communicating the ventilation chamber with the receiving groove, and a partially circular wall located in the heel portion of the midsole and defining an air compression chamber, the partially circular wall having a front air passage connected with a ventilation passage extending through a central portion of the midsole and communicating with ventilation holes provided in a region of the ventilation chamber.

21. A footwear sole as set forth in claim 20, further comprising a plurality of air pockets arranged on opposite sides of the ventilation passage.

22. A footwear sole as set forth in claim 20, further comprising sponge means containing at least one of deodorant and perfume located at least in one of the partially circular wall and the air compression chamber.

23. A footwear sole as set forth in claim 20, further comprising an insole having a ventilation chamber and a round receiving chamber, the footwear sole further comprising cushion air bags located in the ventilation and round receiving chambers of the insole.

24. A footwear sole as set forth in claim 20, wherein cushion air bags are located in the ventilation chamber of the midsole.

25. A footwear sole as set forth in claim 19, wherein said sole member is the outsole, the receiving groove of the outsole being located in the heel portion on an outer side of the outsole, the outsole further including a shank part adjacent to the heel portion and having exhaust means on the outsole outside side, an air compression chamber adjacent to said receiving groove and having air supply and exhaust ports communicating, respectively, with inlet and outlet passage means of the outsole.

26. A footwear sole comprising:

a sole member having a heel portion with an upright outer peripheral side wall and a recess formed in said wall so as to extend along the periphery of the heel portion and inwardly from said side wall, and a horseshoe-shaped shock-absorbing element mounted in said recess and having an outer end surface which is substantially flush with said peripheral side wall, said shock-absorbing element comprising two spaced horizontal walls and a vertically deformable means extending between the two horizontal walls having a connection point with the deformable means and a flange portion extending outwardly beyond the connection point, the flanges of the horizontal walls defining at least a partially hollow space therebetween.

27. A footwear sole comprising:

an insole;

a midsole having front and heel portions;

an outsole having front and heel portions;

a ventilation chamber formed in the front portion of one of the midsole and of the outsole; and a waterproof and ventilation part secured in said one of the midsole and the outsole for communicating air to the ventilation chamber of said one of the midsole and the outsole, the waterproof and ventilation part having a housing with at least one external inlet port communicating with the atmosphere outside said sole, and at least one internal port communicating with the ventilation chamber of said one of the midsole and the outsole, and buoyant means supported in said housing and movable, upon penetration of water into the housing through the at least one external inlet port, from a first position in which it permits flow of air between the at least one external inlet port and the at least one internal port, to a second position in which it prevents flow of water from within the housing through the internal port, said buoyant means being unaffected by said air flow.

28. A footwear sole as set forth in claim 27, wherein the housing has an inlet chamber communicating with the inlet port and an outlet chamber communicating with the internal port, and an opening providing communication between the inlet and outlet chambers; said buoyant means normally spaced from said opening and being buoyantly movable upon penetration of water into the inlet chamber to close said opening.

29. A footwear sole as set forth in claim 28, wherein the housing has opposite vertical external and internal walls having said at least one external inlet port and said at least one internal port, respectively, and upper and lower spaced horizontal plates extending between the vertical external and internal walls, the upper plate having a downwardly extending projection defining at least partially the inlet chamber, the buoyant means comprising a buoyancy plate, and the lower plate having an upwardly extending projection means for supporting the buoyancy plate in the first position.

* * * * *